US005121344A

United States Patent [19]

Laage et al.

[11] Patent Number: 5,121,344

[45] Date of Patent: Jun. 9, 1992

[54] METHOD OF LOCATING UNDERGROUND MINES FIRES

[75] Inventors: Linneas Laage, Eagam; William Pomroy, St. Paul, both of Minn.

[73] Assignee: The United States of America as represented by the Secretary of the Interior, Washington, D.C.

[21] Appl. No.: 657,627

[22] Filed: Feb. 21, 1991

Related U.S. Application Data

[63] Continuation-in-part of Ser. No. 375,549, Jul. 3, 1989, abandoned.

[51] Int. Cl.[5] ..... G08B 17/00; G08B 31/00

[52] U.S. Cl. ..... 364/550; 340/577

[58] Field of Search ..... 364/550, 551.01, 578, 364/513, 580, 900, 557; 340/506, 577, 870.06, 870.09, 870.16, 870.17

[56] References Cited

U.S. PATENT DOCUMENTS 4,023,146 5/1977 Carroll ..... 340/519
4,551,718 11/1985 Cookson et al. ..... 340/506
4,622,538 11/1986 Whynacht et al. ..... 340/506
4,644,478 2/1987 Stephens et al. ..... 340/506
4,749,985 6/1988 Corsberg ..... 340/506
4,773,028 7/1988 Tallman ..... 364/578
4,796,205 1/1989 Ishii et al. ..... 340/577
4,884,222 11/1989 Nagashima et al. ..... 340/577

*Primary Examiner*—Parshotam S. Lall
*Assistant Examiner*—M. J. Zanelli
*Attorney, Agent, or Firm*—E. Philip Koltos

[57] ABSTRACT

An improved method of locating an underground mine fire by comparing the pattern of measured combustion product arrival times at detector locations with a real time computer-generated array of simulated patterns. A number of electronic fire detection devices are linked thru telemetry to a control station on the surface. The mine's ventilation is modeled on a digital computer using network analysis software. The time reguired to locate a fire consists of the time required to model the mines' ventilation, generate the arrival time array, scan the array, and to match measured arrival time patterns to the simulated patterns.

5 Claims, 2 Drawing Sheets

METHOD FOR LOCATING UNDERGROUND MINE FIRES

FLOWCHART OF LFIRE PROGRAM

METHOD OF LOCATING UNDERGROUND MINES FIRES

STATEMENT OF GOVERNMENT INTEREST

The invention described herein may be manufactured by or for the Government for governmental purposes without the payment of any royalty thereon.

This application is a continuation-in-part of U.S. application Ser. No. 07/375,549 filed Jul. 3, 1989 now abandoned.

BACKGROUND OF THE INVENTION

This invention relates to a new and useful method of locating an underground mine fire by measuring the pattern of measured combustion product arrival times at detector locations with a computer-generated array of simulated patterns. Enhanced safety for underground mine workers is a stated policy of the Federal Government. Rapidly determining the location of an underground mine fire has long been a goal of mine ventilation engineers. If the location is known, preferred escape routes can be chosen by miners, rescue teams can concentrate searches in areas where survivors are likely to be found, and fire fighters can select the most efficient route to the fire and the most effective fire fighting strategy. Since the spread of toxic combustion products, and the safety of underground personnel, are greatly influenced and often determined by the mine's ventilation streams, and as a result of research dealing with mine stench fire warning system performance, it was concluded that the analysis of ventilation patterns would provide the most rapid and reliable means for locating the source of contaminant.

The principal disadvantages of the prior art are its inherent slowness, imprecision, and hazard to personnel-the antithesis of an ideal detection system. The only known method of locating a fire in a complex network of underground mine workings is the practice of fire bossing. Fire bossing is the manual inspection of mine workings for signs of fire. The obvious deficiencies of this practice are the time required to survey a mine (some mines comprise hundreds of miles of workings) and the extreme fire, smoke, and toxic gas hazards to the inspectors.

The practice of installing sophisticated electronic fire detection devices at fixed locations in underground mines is growing rapidly. These systems are gaining widespread acceptance as their performance characteristics, and reliability are becoming more well known. Significantly, however, such detection devices are inherently incapable of locating a fire. They are capable only of indicating that a fire exists somewhere in the mine. It is acknowledged that if every branch of a mine network was fitted with a detection device, the location of a fire within the network could be determined. However, as most mines consist of hundreds or even thousands of branches, doing so would be totally impractical. Such fire detection installations typically involve from 1 to 20 detectors, resulting in coverage ratios (number of detectors versus number of network branches) of 1:20 to 1:500. Even under the most favorable conditions, these detectors are capable of indicating only the general area in which a fire is located. Personnel must still be relied upon to manually search miles of working tunnels to find the fire-among the most hazardous of all jobs in mining or any other industry. Also, as this manual search is quite time consuming, and fires tend to grow in size and intensity with time, mine fires often grow to an uncontrollable size before they are found. In the U.S., 78 percent of mine fires discovered within 15 minutes are easily fought and produce little or no damage to mine workings. However, only about $\frac{1}{3}$ of all fires are found within 15minutes.

Functional relationship-based alarm methods have been used for controlling a process as well as fire alarm systems as shown in U.S. Pat. No. 4,749,985 to Corsberg, U.S. Pat. No. 4,692,750 to Murakami et al, U.S. Pat. No. 4,427,974 to Sheahan, U.S. Pat. No. 4,622,538 to Whynacht et al and U.S. Pat. No. 4,551,718 to Cookson et al. The patent to Corsberg describes a methodology which utilizes time-ordered sequences to determine the importance of alarms and to perform other diagnostic functions. In this approach, all possible (or likely) alarm activation sequences are identified and modeled. As a given scenario in the process being monitored develops, the alarm sequence is matched to the modeled sequences in attempting to identify the future state of the process is or is likely to be. This approach is generally presented in the form of logic or cause-consequence trees. Unfortunately these logic trees are difficult and expensive to develop and build, are generally inflexible to change, and are not easily maintained over the life of a plant. As a result, the logic tree approach to alarm analysis has been of limited use in real applications.

The present invention is intended to overcome the aforementioned limitations of the prior art by determining the precise network branch in which the fire is located since each fire location is associated with a unique and recognizable pattern of combustion product arrival times at the various detectors. This capability is superior to the prior art of fire bossing and conventional fire detection systems which only specify the general area of a fire.

SUMMARY OF THE INVENTION

The present invention overcomes the problems in the past by providing an efficient, accurate method of locating underground mine fires without exposing personnel to the underground fire hazard.

Accordingly, it is a primary object of the present invention to provide a method for determining the location of an underground mine fire.

It is another object of the present invention to provide a method for determining the location of a fire in a complex network of mine workings without endangering personnel and in a sufficiently short time to permit safe evacuation.

A still further object of the present invention is to provide a method for determining the location of a fire in a complex network of mine workings using distributed fire detectors and measured contaminant time histories.

These and still other objects of the present invention will be more apparent in the following detailed description of the preferred embodiment.

DETAILED DESCRIPTION OF THE PREFERRED EMBODIMENT

Time is a critical factor if miners are trapped underground. Respiratory protection supplying 1 to 5 hours of breathable air is provided to all underground personnel. However, if they cannot be rescued within that span, their ultimate survival is in great jeopardy. Incomplete or erroneous information regarding the location of a fire severely hampers rescue operations. Analysis of available data indicate that 20–30 percent of the miners who died could have been saved if they had been reached in time by rescue teams.

Figure 1:
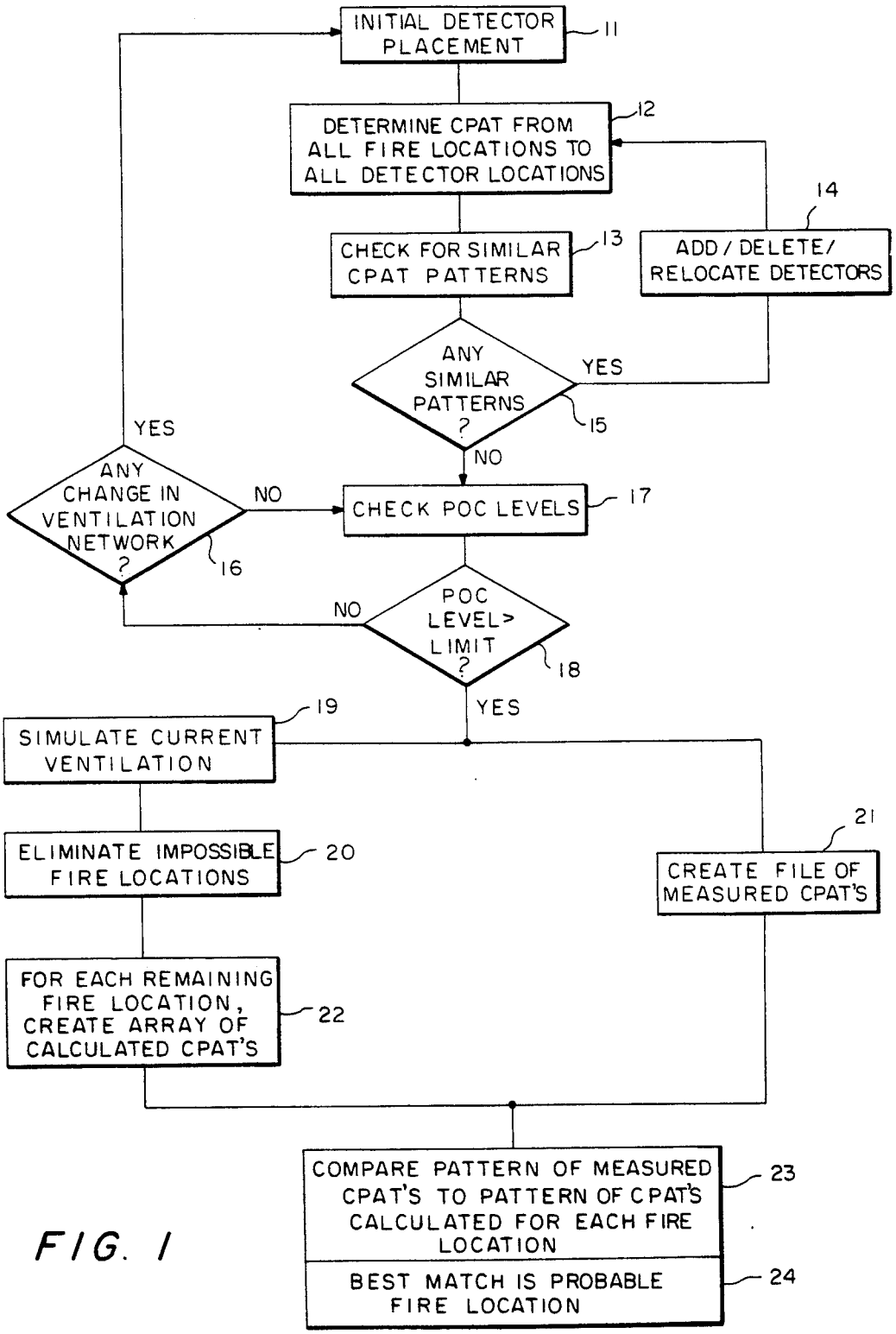
FIG. 1 is a flow chart of the method of locating underground mine fires of the invention.

The process of the instant invention as shown in FIG. 1, comprises several steps. First, a number of electronic fire detection devices 11 are installed in a mine's workings and linked to appropriate telemetry to relay the detection signals to a control station on the surface. The type of detector is somewhat flexible in that the submicron particle (smoke), CO gas, $CO_2$ gas, or a combination of combustion product detectors may be utilized.

It is important to note that the fire location process does not depend on the actual concentration of combustion products measured by the detectors, but rather, the location of the fire is determined by analyzing the Combustion Products Arrival Times (CPAT). at the detectors. Arrival time is defined with reference to the first detector which alarms due to a given fire condition. The arrival time at that detector is defined as time 0. The arrival time associated with the next alarming detector is defined as the elapsed time 0 until that detector alarms. The arrival time for all subsequently alarming detectors is likewise defined as the elapsed time 0 until each respective detector alarms.

Figure 2:
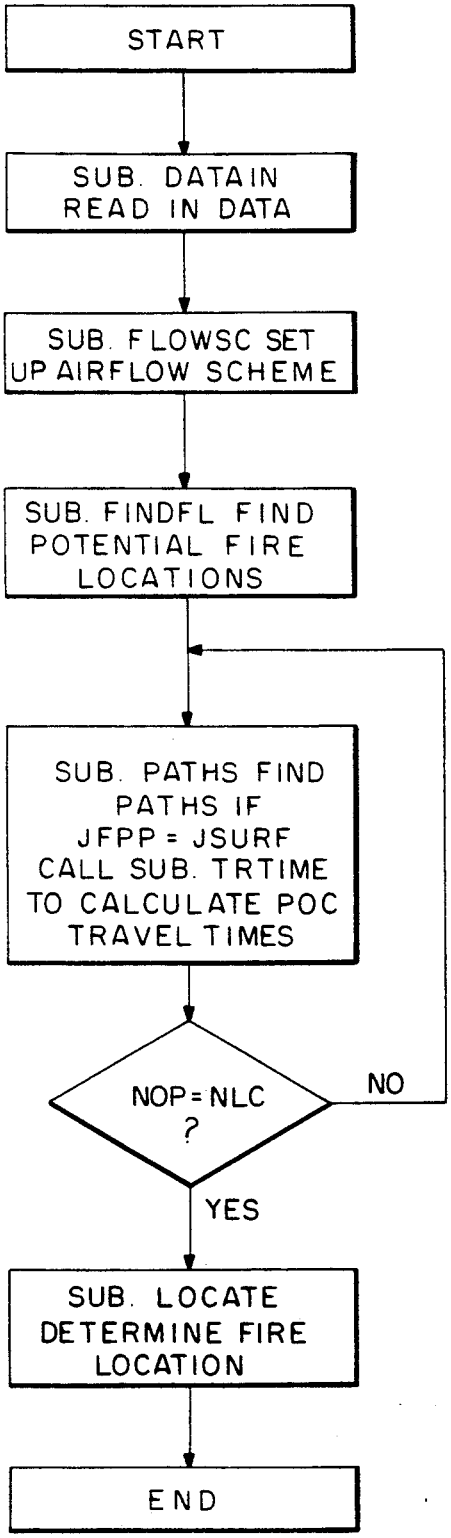
FIG. 2 is a flow chart of the computer LFIRE program.

The proper number and location of detectors is critical to system operation and is determined through an iterative process. The critical requirement that must be satisfied is that products of combustion originating from any potential fire location (every network branch in the mine is considered a possible fire location) must produce a unique pattern of arrival times at the detectors. If fires in any two network branches produce the same arrival time pattern, the detectors need to be rearranged and/or additional detectors added to the system until a unique arrival time pattern is produced for every possible fire location. A computer program, LFIRE, has been created to assist in determining the proper number and location of detectors to insure that this critical requirement is satisfied. The process employed in this computer program is shown in FIG. 2 and blocks 11 through 15 of FIG. 1 and is described later.

The second step in the process of the instant invention is implemented when combustion products (POC) from a fire arrive at any detector 17. At this time, a fire is declared by the fire detection system 18 and two independent processes are initiated. The two processes are to create a computer model of the real-time state of the mine's ventilation 19 and to monitor the arrival of combustion products at other detectors 21. The real-time state of the mine's ventilation is modeled using a digital computer programmed with MFIRE, a specialized mine ventilation network analysis software program. Real-time values for temperature, barometric pressure, humidity, and air flow rates at selected locations within the mine are supplied to the computer by the monitoring system to produce a high degree of accuracy in the ventilation model.

Once the mine's ventilation is modeled, two more computerized processes are initiated. These two processes are to create a numerical array which contains calculated values for combustion product arrival times from every possible fire location to every detector 22 and to eliminate network branches which are impossible fire locations 20. Values for the array of arrival times are calculated using the LFIRE program. Identification and elimination of network branches which are impossible fire locations is accomplished through a computerized process which, in a ventilation context, differentiates between branches which are upstream from a detector, and thus possible fire locations, and branches which are parallel and/or downstream from a detector, and thus not possible fire locations.

As combustion products reach additional detectors, downstream branches from those detectors are also identified and eliminated, as are upstream branches which are not common to all alarming detectors. All branches which are not excluded by this process comprise the possible fire locations. This process of reducing the number of network branches which could be considered possible fire locations is extremely important because the computerized process for determining the fire's location, described in the next paragraph, is computational intensive. Reducing the number of branches that need to be included in this step greatly speeds up the process of locating the fire, and as noted earlier, time is critical.

The final step in the process of the instant invention is the determination of fire location. This is also accomplished by the LFIRE computer program. A comparison is performed between the calculated combustion product arrival time patterns and the pattern of combustion product arrival times actually recorded by the detection system 23. Since every potential fire location is associated with a unique combustion product arrival time pattern (the critical requirement for detector number and location), every combustion product arrival time pattern uniquely defines a specific fire location. The most probable fire location is the network branch defined by the calculated combustion product arrival time pattern which most closely matches the combustion product arrival time pattern actually recorded by the detection system 24.

The iterative process for determining the proper number and location of detectors 11 involves three steps. First, initial detector locations are specified somewhat arbitrarily based on site specific considerations such as availability of power, accessibility, proximity, proximity to perceived fire hazards, etc. Second, for every possible fire location, the time required for combustion products to travel from the fire and arrive at each detector is calculated 12. Every network branch in the mine is considered a possible fire location. Since mines are required by law to utilize forced ventilation systems, the ventilation patterns which carry the combustion products are well known and relatively unvarying, enabling precise calculation of these combustion product arrival times.

The final step in the process for specifying the proper number and location of detectors is a comparison of the arrival time patterns produced for every potential fire location to determine whether two or more fire locations produce similar combustion product arrival time patterns 13. If similar patterns are discovered 15, adjustments in detector number and/or locations are made 14 and the final two steps repeated until no similar arrival time patterns are observed. Each fire location can thereby be associated with a unique and recognizable pattern of combustion product arrival times at the various detector locations. Combustion product arrival times are calculated with a digital computer using the LFIRE program described above.

MFIRE is in the public domain and documented in Bureau of Mines publication IC 9245, "A User's Manual for MFIRE: A Computer Simulation Program for Mine Ventilation and Fire Modeling", 1990. Bureau of Mines publication IC 9206, "Recent Developments in Metal and Nonmetal Mine Fire Protection", pages 35–41, describes a case study experiment which illustrates the application of the method to a real mine.

EXAMPLE I

The preferred embodiment of the instant invention is capable of determining the network branch in which a fire is located. An alternate embodiment, involving software modifications, would enable the system to more precisely locate a fire in that network branch. This enhanced capability would be particularly valuable in cases where the identified branch is unusually long or where the precise location of a fire within the network branch could affect evacuation routes, fire growth, etc. (a fire in a vertical shaft for example). This can be accomplished by applying artificial intelligence techniques to analyze the branch containing the fire. This branch is first divided into several discrete sub-branches. The contaminant arrival time patterns associated with fires in each of the sub-branches are then analyzed iteratively until the sub-branch containing the fire is determined.

EXAMPLE II

The state of a fire, including such considerations as intensity growth rate, and burning substance, can be determined by relating measured contaminant levels and known dilution factors to basic combustion phenomena. For example, since $CO_2$ emissions are a reliable indicator of fire intensity, the time history of $CO_2$ emissions can be used to estimate fire growth rates. Combustion product ratios ($CO:CO_2$) can be used to determine the general nature of the fuel material. Such determinations are impossible without detailed knowledge of the extent to which combustion products generated by a fire are diluted by the ventilation streams. Dilution factors cannot be calculated by the ventilation streams. Dilution factors cannot be calculated without precise knowledge of a fire's location. Thus, prior art technology is incapable of characterizing the state of a fire.

EXAMPLE III

Transducers which measure the velocity and direction of air flow in a network branch could be added to the system to provide additional data regarding fire intensity. As fires can throttle, or even reverse air flows, depending upon their location and intensity, the capability to monitor such ventilation flow disturbances could be used as an independent means of verifying the location and intensity of a fire determined in the conventional manner (ie: arrival times, etc).

While particular embodiments of the present invention have been described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description is offered by way of illustration only and not as a limitation. The actual scope of the invention is intended to be defined in the following claims when viewed in their proper perspective based on the prior art.

We claim:

1. A method of locating underground mine fires comprising the steps of:

(a) installing a plurality of electronic fire detection devices in a mine's workings in a predetermined pattern;

(b) creating and storing a real time generated array representing fire location, detector location, and contaminant arrival time in a computer;

(c) linking said fire detection devices to said computer thru telemetry devices and (d) comparing incoming detector signals generated by said detection devices with said real time generated array whereby each fire location can be associated with a unique and recognizable pattern of combustion product arrival times (CPAT) at said detector locations.

2. The method of claim 1 wherein said predetermined pattern is determined through an iterative process including the steps of selecting tentative locations for detection devices and calculating CPAT for possible fire locations to determine if each location has a unique CPAT for all possible fire locations.

3. The method of claim 1 wherein said real time generated array is created through artificial intelligence techniques to analyze the location containing the fire.

4. The method of claim 1 wherein said combustion product arrival times can be determined by relating measured contaminant levels and known dilution factors to basic combustion phenomena.

5. A method for determining the location of a fire in a complex network of mine workings using distributed fire detectors and measured contaminant histories, comprising the steps of:

installing a plurality of electronic fire detection devices in a mine's workings in a predetermined pattern, said pattern being determined through an iterative process including the steps of;

selecting tentative locations for detection devices, and calculating Combustion Product Arrival Times (CPAT) for possible fire locations to determine if each location has a unique CPAT for all possible fire locations;

creating and storing a real time generated array representing fire location, detector location, and contaminant arrival time in a computer;

linking said fire detection devices to said computer through telemetry device, and comparing incoming detector signals generated by said detection devices with said real time generated array whereby each fire location can be associated with a unique and recognizable pattern of combustion product arrival times at said detector locations.

* * * * *